United States Patent [19]

Joannic

[11] 4,160,469

[45] Jul. 10, 1979

[54] TWISTING DEVICE FOR A MACHINE FOR BINDING PACKAGES WITH WIRE

[75] Inventor: Jean V. Joannic, Paris, France

[73] Assignee: Botalam, Paris, France

[21] Appl. No.: 870,816

[22] Filed: Jan. 19, 1978

[30] Foreign Application Priority Data

Feb. 25, 1977 [FR] France ..... 77 05576

[51] Int. Cl.[2] ..... B21F 15/04

[52] U.S. Cl. ..... 140/115; 140/57; 140/119

[58] Field of Search ..... 140/57, 115, 118, 119, 140/120, 122; 100/31, 33 R

[56] References Cited

U.S. PATENT DOCUMENTS 1,045,994 12/1912 Madison et al. ..... 140/115

*Primary Examiner*—Lowell A. Larson

*Attorney, Agent, or Firm*—Lane, Aitken & Ziems

[57] ABSTRACT

A twisting device for a machine for binding packages with wire, of the type comprising a twisting head in the form of nippers with means for rotating them and causing their opening and closing about the ends of the binding wire.

This device comprises furthermore means for causing a progressive translational movement of the twisting head in the direction of the package to be tied up, as it rotates.

Application: binding of coils of wire or bundling of bars in the iron and steel industry.

2 Claims, 5 Drawing Figures

TWISTING DEVICE FOR A MACHINE FOR BINDING PACKAGES WITH WIRE

The present invention relates to a twisting device for a machine for binding packages with wire, of the type comprising a twisting head in the form of nippers with means for rotating them and causing their opening or closing about the ends of the binding wire.

In binding machines at present known and which are particularly used in the Iron and Steel industry for binding coils of wire or for bundling bars, the packages to be bound are always placed at a fixed distance from the crossing point of the ends of the binding wire in the twisting head. It follows evidently that at the moment of twisting, the two ends of the binding wire cannot slide the length necessary for carrying out the twisting since they are then nipped in the head.

This is why, in these machines, the twisting is often more or less unsymmetrical, according to the initial tension of the binding wire on each side of the package, the flexibility of this latter or even its centring in relation to the twisting axis. Moreover, if both sides of the strap are unduly stretched, the twisting can cause considerable necking of the binding wire which is prejudicial to the strength of the strap thus formed.

The present invention has then as its principal aim to remedy these disadvantages and to do this it has as its object a twisting device of the above-mentioned kind which is essentially characterised in that it comprises furthermore means for causing a progressive movement of translation of the twisting head in the direction of the package to be tied up, as it rotates.

With this arrangement, the twisting head draws progressively nearer the package to be tied while progressively releasing the length of binding wire necessary for winding, which forms a perfectly even and symmetrical twist guaranteeing a good hold of the bond.

In a particular embodiment of the invention, the twisting head is integral with a first piston movably mounted in translation in a fixed cylindrical body and engaging by a threaded part with a corresponding thread provided on the cylindrical body.

Thus, when the twisting head is rotated in the suitable direction, it automatically advances a certain amount in the direction of the package to be tied up, due to the presence of the thread provided for this purpose.

Preferably, the means for rotating the twisting head are formed by a second annular piston mounted slidably keyed on the first piston and engaging by its periphery the inner wall of the fixed cylindrical body by means of a large pitch screw thread, this annular piston being actuated by the pressure of a fluid.

Thus, when the annular piston moves in translation inside the cylindrical body under the action of the fluid pressure, it is also driven in rotation, this rotation being communicated to the first piston carrying the twisting head.

As for the means for causing the opening and closing of the twisting nippers, they are formed by a tightening wedge integral with a third piston slidably mounted inside the first piston, this third piston being subjected to the action of a return spring acting in the opening direction of the nippers and being actuatable in the other direction by the fluid pressure controlling the movement of the annular piston.

With this set of arrangements, two pressure fluid inlets are sufficient for all the movements necessary for the proper operation of the twisting device.

An embodiment of the invention is described hereafter by way of example, with reference to the accompanying drawings in which.

Figure 1:
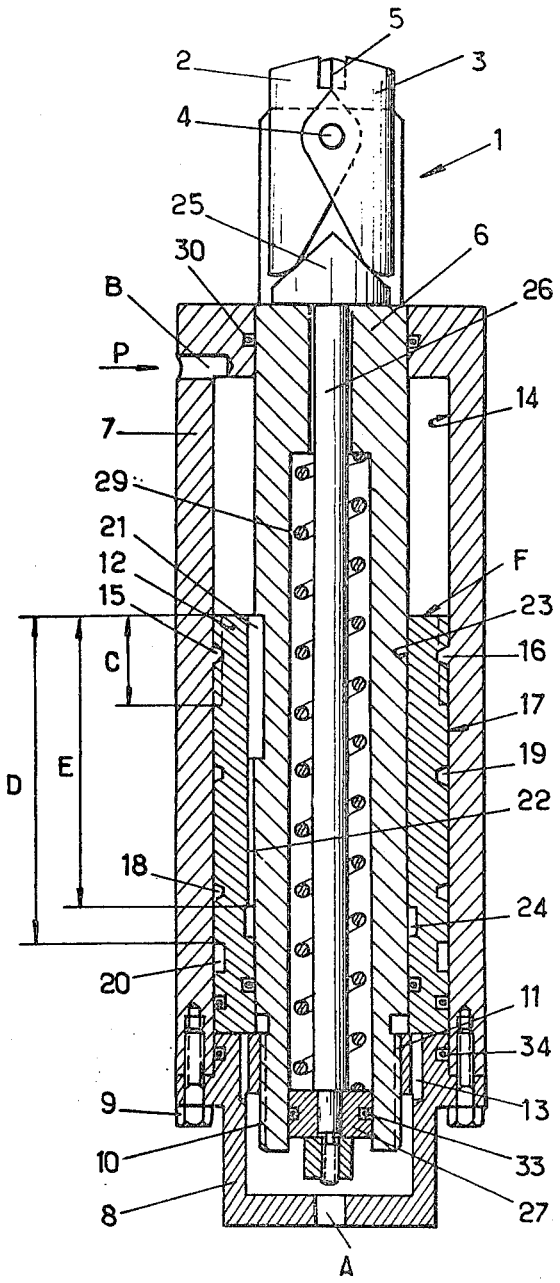
FIG. 1 is a sectional view of a twisting device in accordance with the invention.
Figure 3:
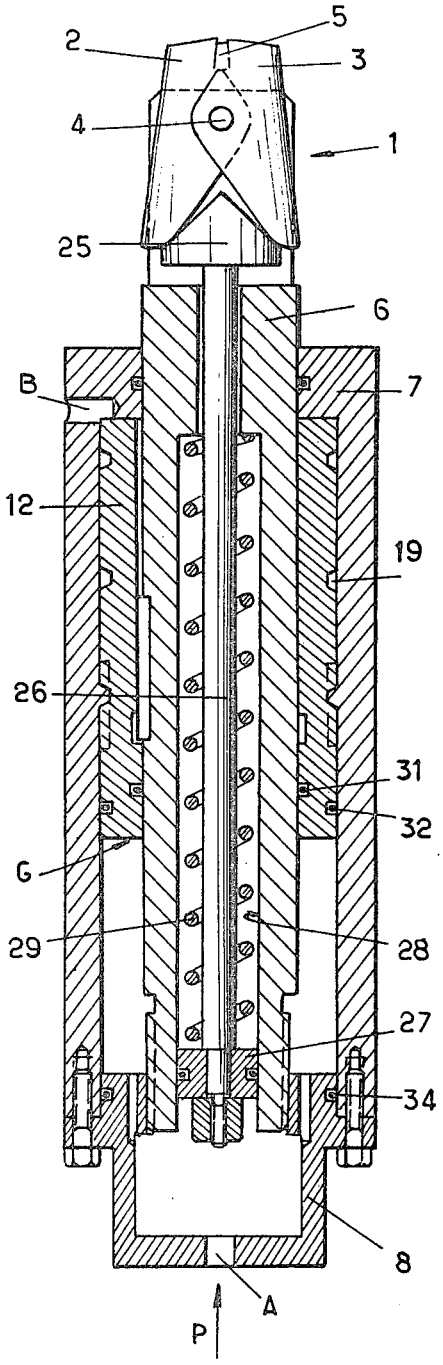
FIGS. 2 and 3 are views similar to FIG. 1 showing the twisting device of the invention in two different operating positions and FIGS. 4 and 5 are schematical views illustrating the operation of this twisting device.
Figure 2:
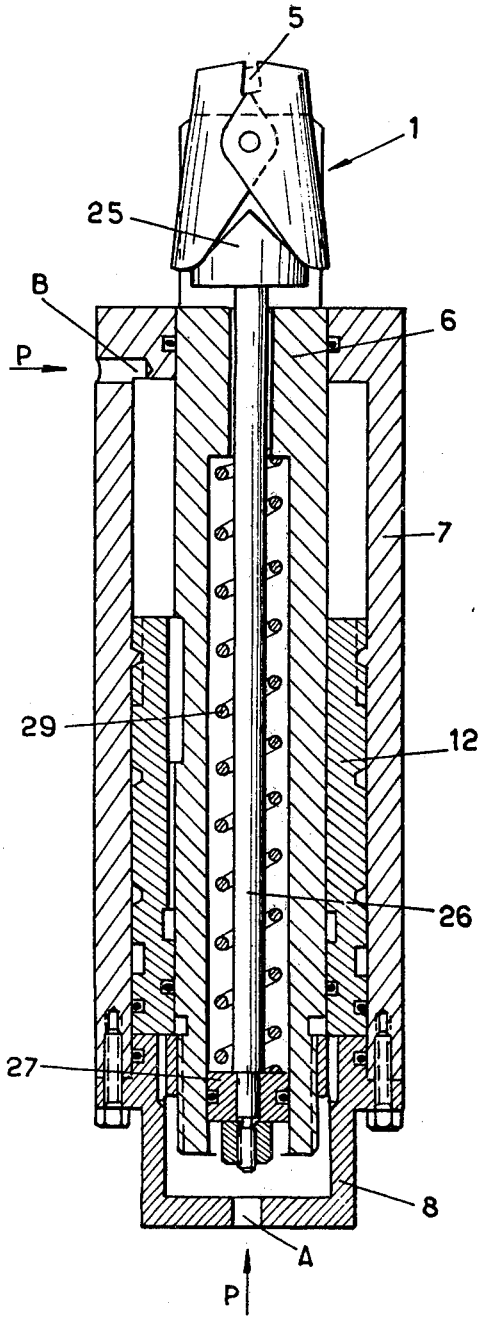

The device shown in FIGS. 1 to 3 comprises first of all a twisting head 1 in the form of nippers, formed essentially by two jaws 2 and 3 hinged about a common axis 4. Between jaws 2 and 3 are provided slots 5 for receiving the binding wire.

Twisting head 1 is carried by the outer end of a first piston 6 disposed inside a fixed cylindrical body 7 whose bottom is formed by a closing member 8 held in place on said body by screws 9.

Piston 6 comprises at its inner end a male thread 10 cooperating with a corresponding female thread 11 provided on the bottom 8 and can thus only move in body 7 by rotating, so with a helical movement.

The rotation of piston 6 is effected by means of a second annular piston 12 disposed between the cylindrical body 7 and the first piston. This annular piston is actuated by the pressure P of a hydraulic or pneuamatic fluid able to be applied on one or the other of its faces F an G by means of two apertures A and B provided respectively in bottom 8 and at the opposite end of cylindrical body 7. Channels 13 are moreover provided in bottom 8 so as to allow the free passage of the driving fluid from aperture A as far as the annular space in which piston 12 moves.

Fixed cylindrical body 7 comprises on its inner wall 14, in a zone C, a double raised screw thread 16 having a large pitch and good reversibility with piston 12 whose outer surface 17 bears a corresponding double hollow screw thread 18,19, over a length D as far as a clearance groove 20. It follows obviously that when it is actuated, piston 12 moves inside cylindrical body 7 with a helical movement.

Annular piston 12 is moreover slidably mounted keyed on piston 6, by means of a key 21 integral therewith and cooperating with a groove 22 provided in outer wall 23 of piston 12. This groove 22 extends over a length E as far as a clearance groove 24.

Thus, the rotary movement of piston 12 is communicated to piston 6 which then also moves with a helical movement, but with a much smaller pitch imposed by thread 10–11.

As for the opening and closing movement of the twisting nippers, it is obtained by means of a tightening wedge 25 acting directly on jaws 2 and 3. This wedge 25 is carried by the end of a rod 26, passing axially through the piston 6 and whose other end is integral with a third piston 27 which is slidably mounted inside a bore 28 specially provided for this purpose in piston 6. It will moreover be noted that the third piston 27 is subjected to the action of a return spring 29 which brings it automatically back to the position corresponding to the opening of the nippers, as shown in FIG. 1.

The device is completed with a number of dynamic joints 31, 32, 33 and a static joint 34 which seal the assembly.

Figure 4:
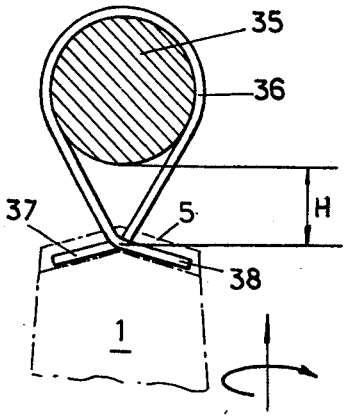
Figure 5:
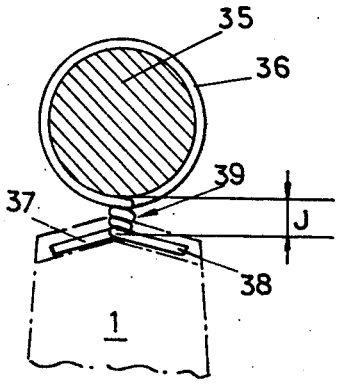

The operation of the twisting device of the invention will now be described with reference particularly to the diagrams of FIGS. 4 and 5 which show the binding of a package 35, assumed circular, by means of a binding wire 36.

At the outset, binding wire 36 is passed around the package to be tied 35, then stretched thereover by conventional means not shown. This done, the two ends 37 and 38 of the binding wire pass into the slots 5 of the twisting nippers which are placed at a distance H from the package 35, as shown in FIG. 4, and are there held in place. The twisting device assembly is then in the position shown in FIG. 1, with fluid pressure P applied to aperture B, whereas aperture A is free-flowing.

In a first stage, jaws 2 and 3 of twisting nippers 1 must be tightened on the ends 37 and 38 of the binding wire. To this end; pressure P is applied to aperture A, without cancelling that acting on aperture B. Pressure P is then applied simultaneously to the two faces F and G of annular piston 12, so that this latter is in a balanced position and so remains motionless.

On the other hand, piston 27 moves in bore 28 under the effect of pressure P applied to aperture A, against the action exerted by return spring 29 and thus drives wedge 25 through rod 26. This done, jaws 2 and 3 of the nippers pivot about pin 4 and grip the two ends 37 and 38 of the binding wire which were up to then held in place in slots 5 by means not shown. The twisting device assembly is then in the position shown in FIG. 2.

In a second stage, strap 36 must be twisted, by bringing closer to package 35 its two ends 37 and 38 which are held in the nipper jaws 2 and 3. For this purpose, the fluid pressure P at aperture B is cancelled and this aperture becomes free-flowing.

The drive fluid acting on aperture A holds piston 27 in position, but also passes through channels 13 in bottom 8 to act on face G of annular piston 12. This latter then screws itself into the reversible thread 15–16 and so rotates piston 6 through key 21 sliding freely in groove 22. Piston 6 screws itself then in its turn into thread 11 from closing bottom 8 and so emerges by rotating from cylindrical body 7 to finally reach the position shown in FIG. 3. This done, head 1 forms on strap 36 a twist 39 whose appearance is illustrated in FIG. 5. It will be noted in particular that ends 37 and 38 of the strap are then brought to a distance J from the package 35.

In a third stage, the nipper jaws 2 and 3 must be released by removing the fluid pressure P at aperture A which then becomes free-flowing. Under the effect of return spring 29, piston 27 then immediately assumes the position which it occupies in FIG. 1, thus allowing the release of the jaws of the nippers which frees the ends 37 and 38 of the strap. As for the annular piston 12, it remains in balance, since it is at the end of its travel on the side of aperture B where there is no fluid pressure. Central piston 6 remains then also in the position which it occupied previously, i.e. emerging from cylindrical body 7, as illustrated in FIG. 3.

The fourth stage corresponds to the return of the twisting device to the starting position shown in FIG. 1. For this, the fluid pressure P is applied to aperture B, while leaving aperture A free-flowing.

Under the action of the drive fluid pressure acting on its face F, annular piston 12 then moves in translation and rotation in body 7 due to the reversible thread 15–16 and thus comes back to butt against bottom 8. This done, central piston 6 is also rotated, through key 21 sliding in groove 22 of the annular piston, and screws itself in the opposite direction in thread 11 of the closing bottom 8, which causes it to retract into body 7. The device is then ready to carry out a new twisting operation.

It can then be seen in short that the four stages necessary for the operation of the twisting device of the invention are obtained with only two hydraulic or pneumatic pressure control apertures, and so in a particularly simple way. Moreover, as the length of binding wire necessary for forming the twist 39 is taken progressively owing to the progressive and simultaneous drawing near of the twisting head, perfectly even and symmetrical twists are obtained in all circumstances without necking, guaranteeing an optimum resistance of the straps thus formed.

What is claimed is:

1. A twisting device for a machine for binding packages with wire, the device having a twisting head in the form of nippers with means for rotating them and causing their opening and closing about the ends of the binding wire, the twisting head being integral with a first piston-like member mounted to be movable in translation in a fixed cylindrical body and having a threaded part engaged with a corresponding thread provided in said cylindrical body to cause a progressive translational movement of the twisting head in the direction of the package to be tied up as it rotates, and characterized in that the means for rotating the twisting head comprises a second annular piston slidably mounted and keyed on the first piston-like member and engaging at its periphery with the inner wall of the fixed cylindrical body by means of a large pitch screw thread, the annular piston being actuated by the pressure of a fluid.

2. A twisting device according to claim 1, characterized in that the means for causing the opening and the closing of the twisting nippers are provided by a tightening wedge integral with a third piston slidably mounted inside the first piston, the third piston being subjected to the action of a return spring acting in the opening direction of the nippers and being actuatable in the other direction by the pressure of the fluid actuating the annular piston.

* * * * *